United States Patent [19]

Marchesini

[11] Patent Number: 4,613,185

[45] Date of Patent: Sep. 23, 1986

[54] FOLDING CHAIR

[75] Inventor: Sisto Marchesini, Montecchio Maggiore, Italy

[73] Assignee: ICU Intercommerz Union S.A., Riva San Vitale, Switzerland

[21] Appl. No.: 641,181

[22] Filed: Aug. 15, 1984

[30] Foreign Application Priority Data

Aug. 17, 1984 [IT] Italy ..... 22630/83[U]

[51] Int. Cl.[4] ..... A47C 4/00

[52] U.S. Cl. ..... 297/39; 297/52

[58] Field of Search ..... 297/39, 19, 51, 52, 297/53, 378; 403/93, 96, 92; 16/325, 327, 330, 331, 332, 333, 341, 342, 345

[56] References Cited

U.S. PATENT DOCUMENTS

| | | | |
|---|---|---|---|
| 369,159 | 8/1887 | Burns | 403/96 X |
| 1,182,515 | 5/1916 | Viragh | 16/341 |
| 1,503,190 | 7/1924 | Kim | 16/341 X |
| 2,709,481 | 5/1955 | Bundai | 297/39 X |
| 2,779,394 | 1/1957 | Csorgo | 297/53 |
| 2,851,086 | 9/1958 | Weiner | 297/39 |
| 3,047,334 | 7/1962 | Vanderminden | 297/39 |
| 3,279,734 | 10/1966 | Kramer | 297/39 X |
| 3,316,013 | 4/1967 | Abel et al. | 297/16 |
| 3,319,997 | 5/1967 | Clement | 297/16 |
| 3,715,142 | 2/1973 | Lay et al. | 297/39 |

FOREIGN PATENT DOCUMENTS

| | | | |
|---|---|---|---|
| 652759 | 11/1962 | Canada | 16/331 |

*Primary Examiner*—Francis K. Zugel
*Assistant Examiner*—José V. Chen
*Attorney, Agent, or Firm*—Fleit, Jacobson, Cohn & Price

[57] ABSTRACT

A folding chair having a first, seat frame and a second, backrest frame, the frames articulated to supporting leg frames and lateral armrests. A cup member is secured to the rear ends of the seat frame, and the backrest frame is hinged to the cup member. A toggle element is pivoted to the cup member and to a rear leg of the chair, the toggle element being provided with a rest portion which comes to rest against the rear leg. A retainer in the form of a detent and a recess are provided on the cup member and on the toggle element, respectively, to prevent the rotation of the toggle element with respect to the cup member when the chair is open.

11 Claims, 6 Drawing Figures

FOLDING CHAIR

BACKGROUND OF THE INVENTION

This invention refers to a folding chair having a toggle joint device between the rear legs of the chair, the seat frame and the backrest frame, which is designed to keep the chair in a stable condition when open.

There are known folding chairs in which the seat and backrest frames are made from metal sections or tubes, and are articulated to front and rear legs which are connected to lateral armrests; in a number of known types, the articulations between the tubular frames consist of simple pins which, with the aid of suitable additional braces, permit the chair to open and to maintain such condition. However, this type of chair proves to be complicated in structure and somewhat unreliable in that the rear legs are likely to fold up, causing the chair to close and fall; moreover, the additional braces are usually placed close to the seat frame, with the danger of causing injury to the hands. A further known type of chair includes longitudinal grooves along the innner side of the rear legs, in which slides a respective stop pin, constituting the articulation between the seat and backrest. Apart from involving an additional machining operation, the use of grooves in the tubular legs weakens the chair structure thereby making it wholly unreliable, in that even the slightest deformation of the legs and, consequently, of the grooves themselves, could cause the pins to come out, damaging the chair irreparably.

An object of this invention is to provide a folding chair, of the type described, but which is simple in structure and reliable in use, in that it does not present weakened parts, and which remains stable in the open position, with no danger whatsoever for the user.

SUMMARY OF THE INVENTION

According to this invention, a folding chair is provided, of the type comprising a first frame defining the seat and a second frame defining the backrest, said frames being pivoted to each other and to front and rear supporting leg frames made of U-shaped tubular elements, the upper ends of which are hinged to lateral armrests, wherein each lateral articulated joint between the frames of the backrest, seat and rear legs of the chair, includes a cup member secured to one rear end of the seat frame, a corresponding lower end of the tubular backrest frame being hinged to said cup member. A toggle element is hinged to a rear leg and to the cup member, respectively, the toggle element having a rest portion which comes to rest against a rear leg when the chair is in the open condition; and retaining means between the cup member and the toggle element to prevent rotation when the chair is in the open condition.

BRIEF DESCRIPTION OF THE DRAWINGS

A particular embodiment of the folding chair and of the rear toggle-joint device will be illustrated hereunder, by reference to the accompanying drawings, in which.

DESCRIPTION OF THE INVENTION

Figure 1:
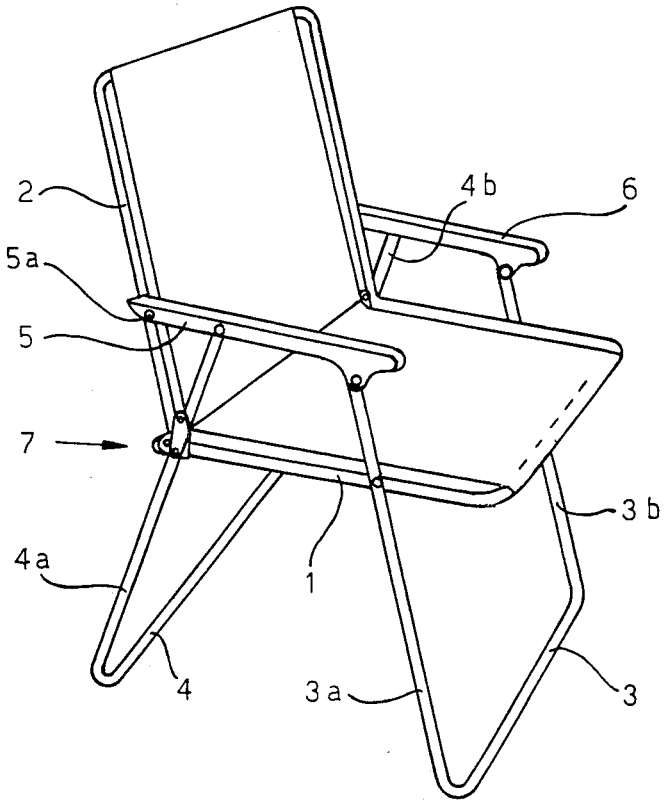
FIG. 1 shows a perspective view of the chair.

As shown in FIG. 1, the folding chair includes a first metal frame 1, defining the seat, and a second metal frame 2 defining the backrest, said frames 1 and 2 being formed from tubular elements that are bent into a U-shaped frame; numerals 3 and 4 identify correspondingly formed U-shaped tubular elements defining the front legs 3*a*, 3*b* and, respectively, the rear legs 4*a*, 4*b* of the chair, and which are pivoted to the seat frame 1, as shown, and which extend upwards and are hinged to lateral armrests 5 and 6; the armrests 5 and 6 are, in turn, hinged, at 5*a*, to the backrest frame 2.

Figure 2:
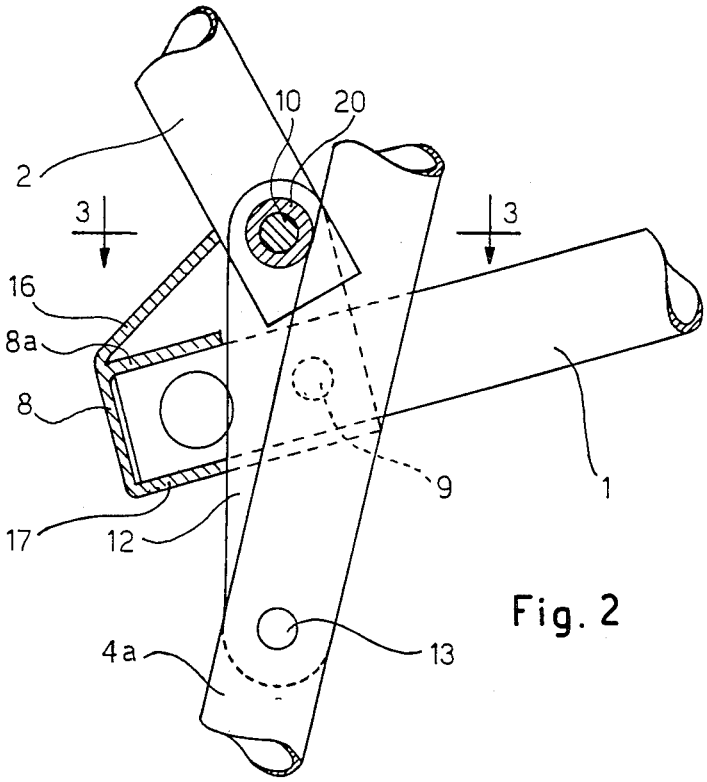
FIG. 2 shows a cross-sectional view of an enlarged detail showing the toggle joint at the rear.
Figure 3:
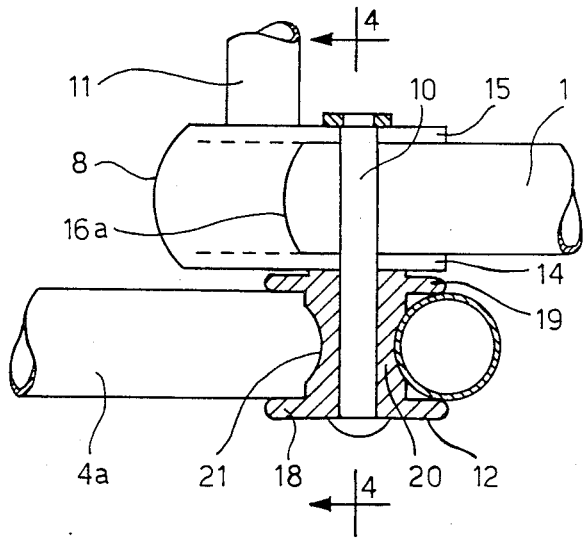
FIG. 3 shows a cross-sectional view along the line 3—3 of FIG. 2, with several parts removed.
Figure 4:
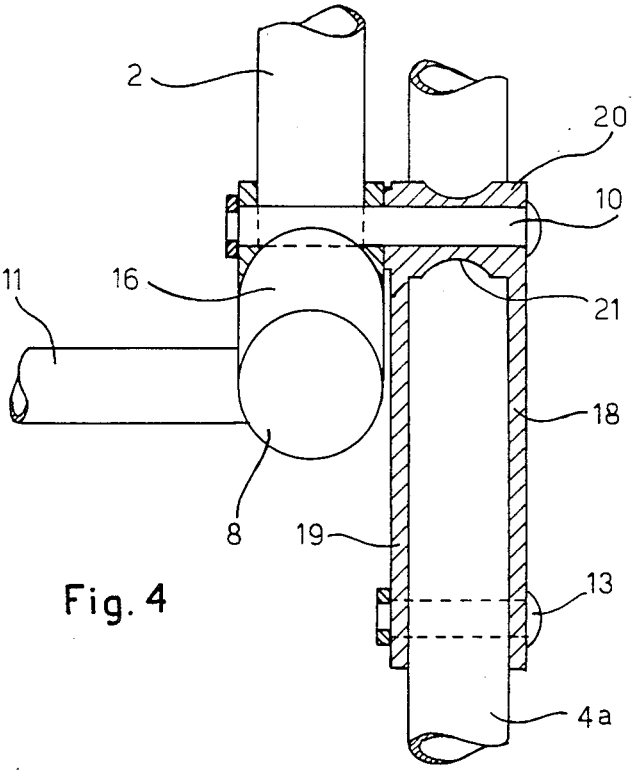
FIG. 4 shows a cross-sectional view along the line 4—4 of FIG. 3.

Reference numeral 7 in FIG. 1 identifies a rear toggle joint device (only one of which is clearly visible in FIG. 1), which connects the legs 4*a*, 4*b* and the frames 1 and 2; this joint device is shown in greater detail in the enlarged views of FIGS. 2, 3 and 4.

The joint device 7 comprises connecting means in the form of a cup member 8 secured by means of a rivet 9, or other equivalent means, to the rear end of a corresponding side of the seat frame 1. Hingedly connected at pin 10 to the cup member 8 (FIG. 2), is the lower end of a corresponding side of the backrest frame 2; the cup member 8 also serves as a connecting element for receiving a transverse rod 11 which extends between and bridges the two sides of the seat frame 1, as shown, at the open end thereof.

The joint device 7 comprises, moreover, a toggle element 12, one end of which is hingedly connected at pin 13 to a corresponding rear leg 4*a* or 4*b* of the chair, and the other end of which is hingedly connected to the pin 10, which defines the pivoting axis of the aforesaid backrest frame, and which serves to hold toggle element 12 adjacent to said cup member 8.

In particular, as shown in the various drawing figures, the cup member 8 includes two spaced, flat, substantially parallel walls 14 and 15 through which pass the rivet 9 and pin 10, a lower wall 17 and a rear wall, from which a forward-sloping portion 16 extends. Within cup member 8 a seat 8*a* is provided for receiving a corresponding end of the U-shaped tubular seat frame 1. The sloping surface 16 of the cup member 8 is not strictly indispensable, however it serves as a reinforcement and its length must be such as to provide sufficient space to permit the frame 2 to rotate when the chair is relative to cup member 8 moved between the open and the closed position.

According to the example shown in the drawings, the toggle element 12 is in the form of a forked element, comprising two spaced toggle levers 18 and 19 which are situated in parallel planes on either side of each rear leg 4*a* and 4*b*. The levers 18 and 19 are each hinged at the lower part thereof to the leg 4*a* by means of the pin 13, whereas on the upper part they are hinged to the pin 10, being held apart at the upper part by an intermediate portion, for example, in the form of a rest reel 20 situated to the rear of the leg 4*a*. The reel 20 represents a circumferential groove 21 designed to form a rest surface which rests against the rear surface of rear leg 4*a* or 4*b* at a point between pin 13 and the upper, open end of rear tubular element 4 supporting the armrest 5, 6. The rest reel 20 may be made integral with the toggle levers 18 and 19, for example, in the case of the cup member 8 and the toggle element 12 both being moulded from plastic material, or it may be made separately and connected to the aforesaid levers by means of the same pin 10.

The toggle joint device 7 as shown includes retaining means for preventing relative rotation between the cup member 8 and the toggle element 12 when the chair is in the open position. In the embodiment of FIGS. 2–4, these retaining means may simply operate by friction (FIG. 3) by exerting a suitable amount of pressure between the opposing flat surfaces of the side walls 14 of the cup member 8 and of the lever 19 of the toggle element 12, for example, by using pins 10 of a suitable length or, in order to take up any possible slack, by using an intermediate friction element, for example in the form of a cupped washer 25 (FIG. 5) interposed between the head of the pin 10 and the lever 18, or in any other way.

Figure 5:
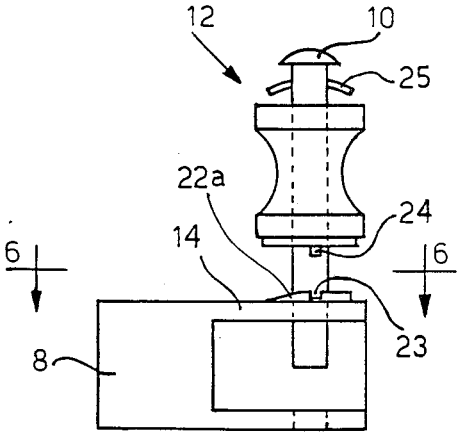
FIG. 5 shows an exploded view, in order to show the retaining means between the cup member and the toggle element.
Figure 6:
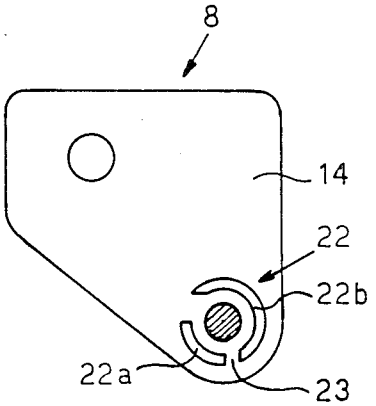
FIG. 6 shows a view along the line 6—6 of FIG. 5.

FIGS. 5 and 6 show the use of cooperable retaining means between the cup member 8 and the toggle element 12, which may snap into and out of engagement, the orientation of the parts as shown in FIG. 5 being with the chair in the open condition but spaced from each other along pin 10 to facilitate understanding. These cooperable retaining means are always situated on the opposite surfaces of the cup member 8 and of the toggle lever 19, and include a cam retaining means arranged along a circumference concentric to the pivot pin 10 of the backrest.

In particular, the cam retaining means comprise a circular protrusion 22 concentric to the pivot pin 10 connected to the backrest frame 2, and provided on the external surface of the flat side wall 14 of the cup 8. The protrusion 22 consists of two raised sectors of a circle **22*a*, 22*b*, the first of which, 22*a*, forms a ramp (see FIG. 5) which gradually increases in height starting from zero, that is to say, from the external surface of the flat side wall 14 of the cup member 8, gradually reaches the established final height of the protrusion and then stops suddenly. The second sector 22*b* is of a constant height equal to the final height of the first sector 22*a*. The two circular sectors 22*a* and 22*b* are circumferentially spaced apart from each other, and between the end of the first circular sector 22*a* where it reaches the maximum height and the beginning of the second circular sector 22*b*, there is a cavity or recess 23, which can be penetrated by a detent 24 forming an integral part of one of the toggle levers 18 or 19 of the toggle element 12. The detect 24 is situated on a diameter corresponding to the average diameter of the circular protrusion 22 and is placed at such an angular position that it snaps into the cavity 23, after having climbed the ramp 22*a*, when the backrest frame 2 is sloping correctly relative to the seat frame 1** with the chair completely open.

As the chair opens, the toggle element 12, in rotating, causes the detent 24 to slide with respect to wall 14 of the cup member 8, said sliding being made possible by the fact that in the position in which the chair begins to open, the detent 24 encounters the beginning of the ramp **22*a*. As the chair continues to open, the detent 24 continues to slide up the ramp 22*a*, which gradually increases in height, and then stops suddenly, thus causing the detent 24 to snap into the cavity 23 provided between the two sectors 22*a*, 22*b*. This point corresponds to the fully open condition of the chair, in which the toggle element 12** rests against the respective rear leg.

To close the chair, it is necessary to use a certain amount of force to make the detent 24 climb the step defined by the rear end of the sector **22*a* in order to disengage the cup member 8 from the toggle element 12 which, rotating on the pivoting pin 10** of the backrest, enables the chair to close.

It is clear therefore, from what has been described and shown in the accompanying drawings, that the use of the cup member 8 and the toggle element 12 in place of the usual braces or hinge pins between the legs and the frames 1 and 2 of the chair, makes it possible to simplify the chair structure and to eliminate sources of danger; moreover, it makes the open chair extremely stable, thanks to the circumferential groove 21 of toggle element 12 resting firmly against the rear legs.

When the chair is open, the pins 10 and 13 of the toggle element 12 are advantageously situated on the opposite sides of the frame 1, keeping the upper pin 10 in a slightly forward position with respect to the lower pin 13 in order to ensure the desired stability.

What is claimed is:

1. A folding chair movable from a folded, collapsed position, to an unfolded, open position, said chair comprising:

(a) chair seat means having a front portion, a rear portion, and opposed side portions;

(b) backrest means having a top portion, a bottom portion, and opposed side portions;

(c) connection means extending between the rear portion of said seat means and the bottom portion of said backrest means for pivotally connecting the rear portion of said seat means with the lower portion of said backrest means;

(d) a pair of front legs pivotally carried by respective opposite side portions of said seat means;

(e) armrest means extending between and connnecting said front legs to respective opposite side portions of said backrest means;

(f) a pair of rear legs pivotally connected with said armrest means at a point between said backrest means and said front legs;

(g) lever means pivotally extending between and connecting respective ones of said rear legs and said side portions of said backrest means; and (h) cooperable retaining means including a detect and a recess and carried by opposed, relatively slidable surfaces of respective ones of said connection means and said lever means, to releasably maintain said lever means and said connection means in a predetermined relative orientation to maintain said chair in an open, unfolded condition, said detent engaged with said recess when said chair is in the open, unfolded condition and disengaged therefrom when the elements of said chair are pivoted relative to each other to move the chair toward a closed condition, in which the retaining means include a first retaining element in the form of a cam surface defining a ramp progressively increasing in height and terminating in a recess, said cam surface positioned on one of said connection means and said lever means, and a detent on the other of said connection means and said lever means, said cam and said detent being in radial correspondence relative to a circle concentric to a pivot between the connection means and the lever means, the detent being engageable with said recess in the open condition of the chair to provide stability to said chair when in the open condition and prevent unintended folding thereof.

2. A chair as claimed in claim 1, in which said cam surface is in the form of a sector of a circle and said recess for engagement with the detent is in a pre-established angular position relative to said connecting means.

3. A chair as claimed in claim 1, in which said retaining means includes a biasing means positioned axially relative to a pivot pin connecting the connection means and the lever means, said biasing means urging said lever means against said connection means.

4. A chair as claimed in claim 3, in which said biasing means is in the form of a cupped washer.

5. A chair as claimed in claim 1, in which said connection means includes flat side walls and means defining an internal seat for receiving an end of a side portion of the seat means.

6. A chair as claimed in claim 1, in which said lever means includes two flat levers each hingedly connected at one end to respective opposing sides of a rear leg of the chair, and an intermediate upper element at another end of said levers, said intermediate element having an outer rest surface for contact against the rear leg of the chair.

7. A chair as claimed in claim 1, in which said lever means includes rest means cooperable with a rear leg when said chair is in an open condition for increased stability of the open chair, said rest means including a groove engageable with a rearwardly facing, outer surface of said rear leg.

8. A chair as claimed in claim 1, in which the lever means is a toggle including two laterally spaced parallel levers interconnected at one corresponding end of each lever by an intermediate member to space the levers from each other.

9. A chair as claimed in claim 8, in which said intermediate member includes a groove engageable with a rearwardly facing, outer surface of said tubular rear leg.

10. A fold chair of the type including a first tubular, U-shaped frame defining a backrest; a second tubular, U-shaped frame defining a seat; a pair of laterally spaced armrests; front and rear supporting legs made from tubular, U-shaped members and means for pivoting the front and rear legs to the second tubular frame and to the armrests to permit the backrest and seat frames to be pivoted relative to each other between an open, unfolded position and a closed, folded position, the improvement comprising:

a cup member secured to ends of the U-shaped seat frame, a link member pivoted to a rear leg and pivoted to a corresponding cup member and to the backrest frame by means of spaced pivot axes, one axis passing through said cup member and the backrest frame and another axis passing through the rear leg, and detent means on one of the cup and the link member, and recess means on the other of the cup member and the link member and cooperable with the detent means, said detent and recess means being engageable and disengageable with each other by pivoting movement of the seat and backrest frames relative to each other to and from an open condition, respectively, of the folding chair.

11. A folding chair of the type including a first tubular, U-shaped frame defining a backrest; a second tubular, U-shaped frame defining a seat; a pair of laterally spaced armrests; front and rear supporting legs made from tubular, U-shaped members and means for pivoting the front and rear legs to the second tubular frame and to the armrests to permit the backrest and seat frames to be pivoted relative to each other between an open, unfolded position and a closed, folded position, the improvement comprising:

a cup member secured to ends of the U-shaped seat frame, a link member pivoted to a rear leg and pivoted to a corresponding cup member and to the backrest frame by means of spaced pivot axes, one axis passing through said cup member and the backrest frame and another axis passing through the rear leg, retaining means carried by the cup member and the link member, the retaining means being engageable and disengageable by pivoting movement of the seat and backrest frames to and from an open condition, respectively, of the folding chair, said link member including two flat levers each hingedly connected at one end to respective opposing sides of a rear leg of the chair, and an intermediate upper element at another end of said levers, said intermediate upper element having an outer rest surface for contact against the rear leg of the chair.

* * * * *